US008857777B2

(12) United States Patent
Chang

(10) Patent No.: US 8,857,777 B2
(45) Date of Patent: Oct. 14, 2014

(54) ANTI-THEFT/SAFETY HANGER

(71) Applicant: Chi-Tsai Chang, Taichung (TW)

(72) Inventor: Chi-Tsai Chang, Taichung (TW)

( * ) Notice: Subject to any disclaimer, the term of this patent is extended or adjusted under 35 U.S.C. 154(b) by 0 days.

(21) Appl. No.: 13/689,152

(22) Filed: Nov. 29, 2012

(65) Prior Publication Data

US 2014/0084128 A1 Mar. 27, 2014

(30) Foreign Application Priority Data

Sep. 21, 2012 (TW) ..... 101218281 A

(51) Int. Cl.

| | |
|---|---|
| ***A47H 1/10*** | (2006.01) |
| ***A47F 7/00*** | (2006.01) |
| ***B65D 73/00*** | (2006.01) |
| ***B25B 13/06*** | (2006.01) |

(52) U.S. Cl.

CPC ..... *A47F 7/00* (2013.01); *B65D 2211/00* (2013.01); *B65D 73/0064* (2013.01); *B25B 13/06* (2013.01); *Y10S 206/806* (2013.01)

USPC ..... 248/317; 248/224.7; 206/378; 206/806

(58) Field of Classification Search

USPC ..... 248/314, 309.1, 223.41, 224.7, 316.1, 248/316.7, 909, 224.8; 206/378, 493, 806, 206/1.5, 377, 346; 40/617, 673; 211/70.6; 224/271, 904; 403/3, 169, 170, 165, 403/300, 301, 326, 329, 361, DIG. 14

See application file for complete search history.

(56) References Cited

U.S. PATENT DOCUMENTS

| | | | | |
|---|---|---|---|---|
| 6,450,338 | B1 * | 9/2002 | Chen | 206/378 |
| 6,581,894 | B1 * | 6/2003 | Tong | 248/314 |
| 6,672,555 | B2 * | 1/2004 | Chang | 248/317 |
| 6,854,594 | B2 * | 2/2005 | Vasudeva et al. | 206/1.5 |
| 8,448,787 | B1 * | 5/2013 | Chang | 206/378 |
| 2006/0207951 | A1 * | 9/2006 | Wang | 211/70.6 |
| 2008/0128370 | A1 * | 6/2008 | Shih | 211/70.6 |
| 2009/0158787 | A1 * | 6/2009 | Lin | 70/58 |
| 2009/0266956 | A1 * | 10/2009 | Shih | 248/221.11 |

FOREIGN PATENT DOCUMENTS

| | | |
|---|---|---|
| TW | 547288 | 8/2003 |
| TW | M376405 | 3/2010 |

* cited by examiner

*Primary Examiner* — Nkeisha Smith
(74) *Attorney, Agent, or Firm* — Muncy, Geissler, Olds & Lowe, P.C.

(57) ABSTRACT

An anti-theft/safety hanger is provided with a plate body having an U-shaped wedge portion. The wedge portion includes a wedge corner portion on one of sidewalls and is connected to the plate body via a connecting edge. The wedge corner portion is movable between a first position and a second position. When the connecting edge is uncut-off, the wedge corner portion is located in the first position and the wedge portion is relatively undeformable so that a socket sleeved around the wedge portion is limited and detachable. When the connecting edge is cut off, the wedge corner portion is pushed and blocked by a blocking corner portion of the plate body so as to be located in the second position. The wedge portion is depressed, and the socket is thus unblocked by the wedge portion and detachable.

2 Claims, 6 Drawing Sheets

ANTI-THEFT/SAFETY HANGER

BACKGROUND OF THE INVENTION

1. Field of the Invention

The present invention relates to an anti-theft/safety hanger, more particularly, to an anti-theft/safety hanger adapted for a socket secured thereto for exhibition.

2. Description of the Prior Art

A conventional hanger for securing a socket thereto is generally provided with function of preventing detachment of the socket so as to achieve anti-theft effect. However, the hanger needs to be removed before the tool is used, wherein the anti-theft structure or means of the hanger must be removable by the user. A conventional hanger as disclosed either in TW M376405 or TW547288, an U-shaped structure is inserted into a socket, in which the U-shaped structure includes a projective positioning portion for correspondingly wedging in a positioning groove in the socket so as to prevent detachment of the socket. When the user cuts off or snips off a part of the U-shaped structure, the U-shaped structure is in a relatively deformable status and can be pinched to deform inwardly, and the positioning portion is thus detachable from the positioning groove so that the tool can be detached from the U-shaped structure.

However, the aforementioned conventional structure is not convenient to use. The cut-off part of the U-shaped structure has a free end which can result in restorable deformation of the U-shaped structure during an external force is applied on the U-shaped structure. That is, the user has to keep pinching the U-shaped structure when the tool is moving away from the U-shaped structure. If the U-shaped structure does not be kept pinched when the tool is moving away from the U-shaped structure, the tool is still wedged with the U-shaped structure when the tool is moving away from the U-shaped structure, the positioning portion cannot be effectively removed from the positioning groove and the tool cannot be effectively detached from the hanger. Besides, it is not convenient to pinch the U-shaped structure with one hand and withdraw the tool from the hanger simultaneously. Moreover, the user's hand might be injured by the sharp cutting edge of the cut-off part.

The present invention is, therefore, arisen to obviate or at least mitigate the above mentioned disadvantages.

SUMMARY OF THE INVENTION

An object of the present invention is to provide an anti-theft/safety hanger which can position a socket and prevent the detachment of the socket, wherein the socket can be easily detached via simply cutting off a portion of the hanger.

To achieve the above and other objects, an anti-theft/safety hanger includes a plate body. The plate body includes a first end and a second end corresponding to each other. The first end is formed with a hanging portion, and the second end is formed with a wedge portion. The wedge portion is adapted for a socket to be sleeved therearound. A receiving space is formed between the wedge portion and the plate body, and the wedge portion is selectively deformable. One end of the wedge portion toward the plate body is connected to the plate body, and the wedge portion is formed with a wedge corner portion. The wedge corner portion is connected to the plate body via a connecting edge, and the wedge corner portion is selectively movable between a first position and a second position. The second end of the plate body is formed with a blocking corner portion extending inwardly toward the receiving space, and the wedge portion is formed with a projective positioning portion. When the connecting edge is uncut-off or unsnipped-off, the wedge corner portion is located in the first position, the wedge portion is limited by the connecting edge so that the wedge portion is relatively undeformable, and the socket is blocked by the positioning portion so that the socket is undetachable from the wedge portion. When the connecting edge is cut off or snipped off, the wedge portion is relatively deformable so that the wedge corner portion is allowed to be pushed into the receiving space and is blocked in the second position by the blocking corner portion, the wedge portion is depressed so that the positioning portion moves backward, and the socket is unlimited by the positioning portion and permitted to detached from the wedge portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
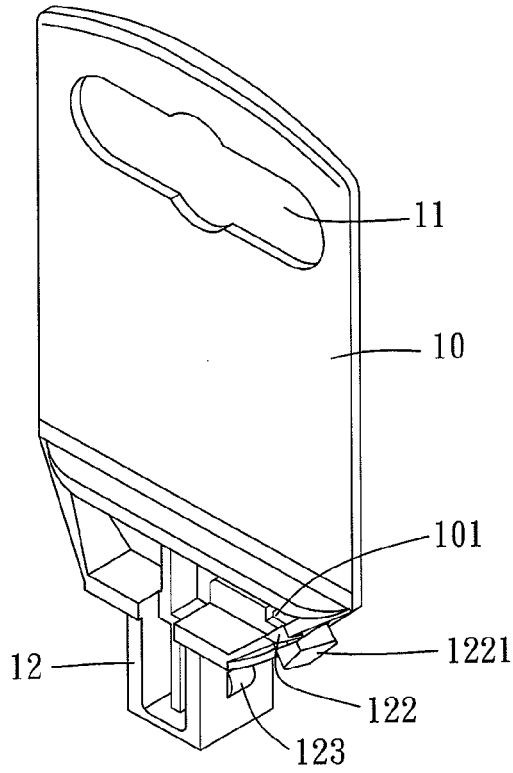
FIG. 1 is a perspective view of a preferred embodiment of the present invention.
Figure 2:
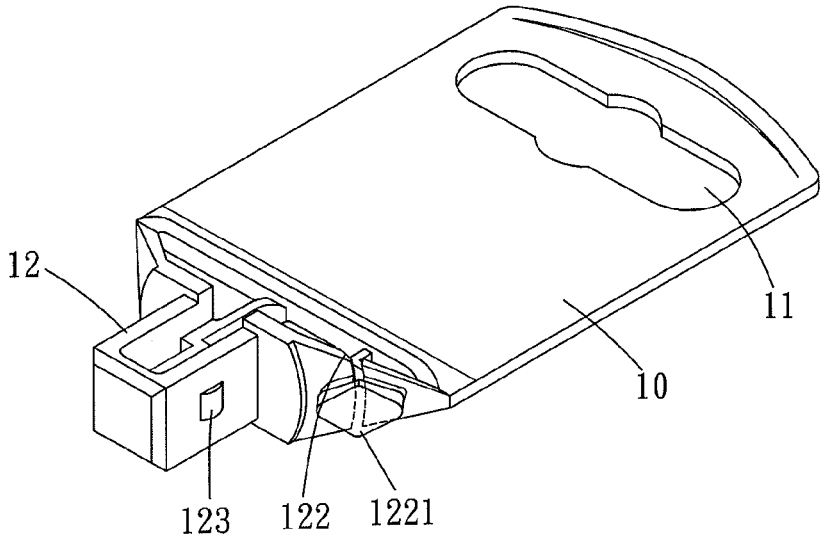
FIG. 2 is another perspective view of a preferred embodiment of the present invention.
Figure 3:
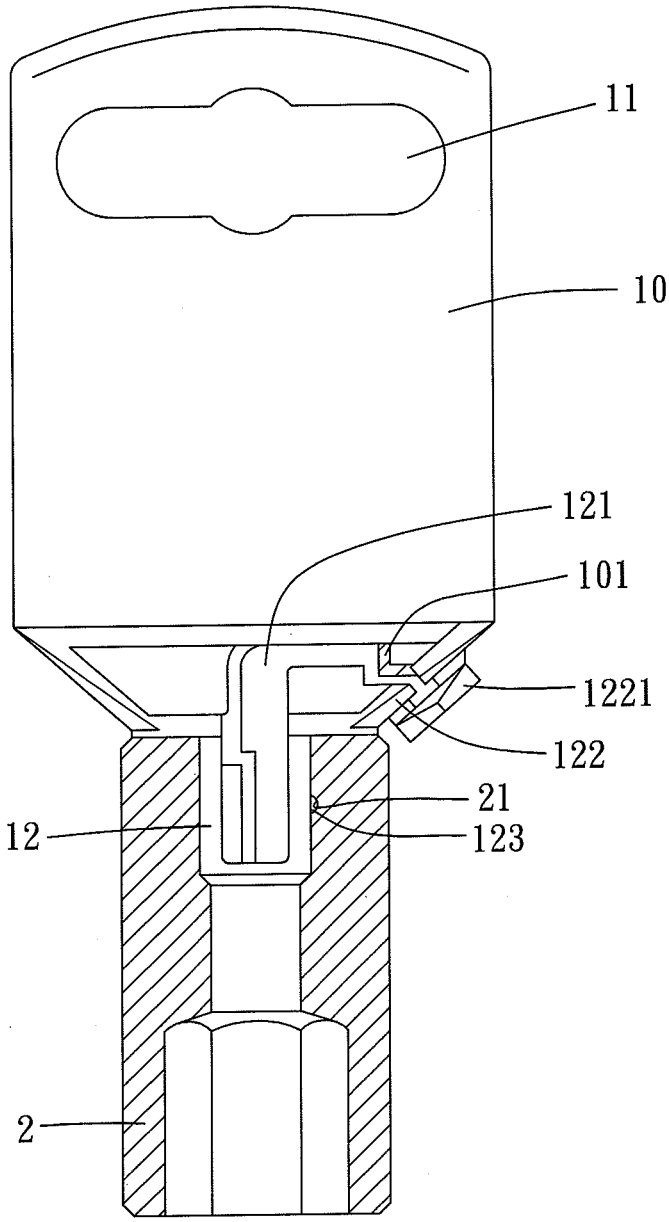
FIG. 3 is a front view according to a preferred embodiment of the present invention.

As shown in FIGS. 1-3, an anti-theft/safety hanger according to a preferred embodiment of the present invention includes a plate body 10. The plate body 10 includes a first end and a second end corresponding to each other. The first end is formed with a hanging portion 11, and the second end is formed with a wedge portion 12. In this embodiment, the hanging portion 11 is an elongated hole which is adapted for the hanging of the hanger on a hook or other exhibition device in an exhibition space.

Figure 5:
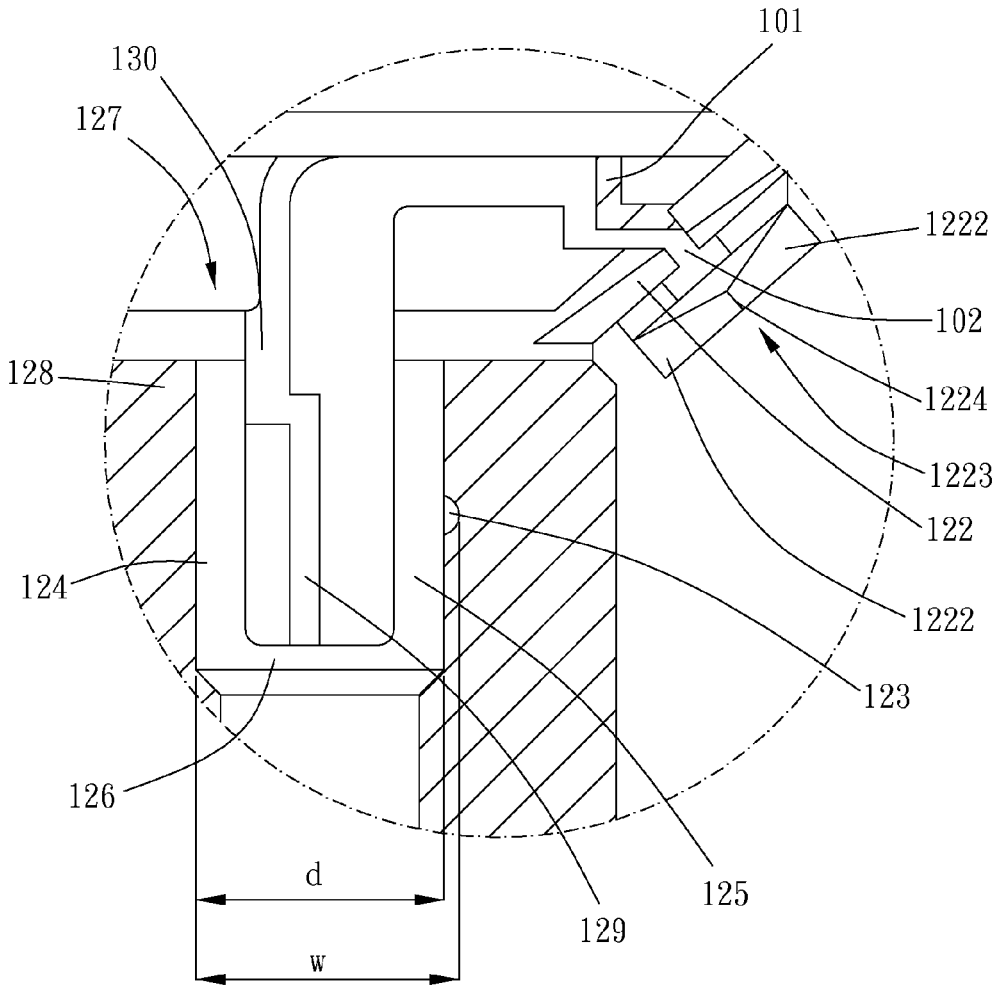
FIG. 5 is a partially enlarged drawing of FIG. 3.
Figure 6:
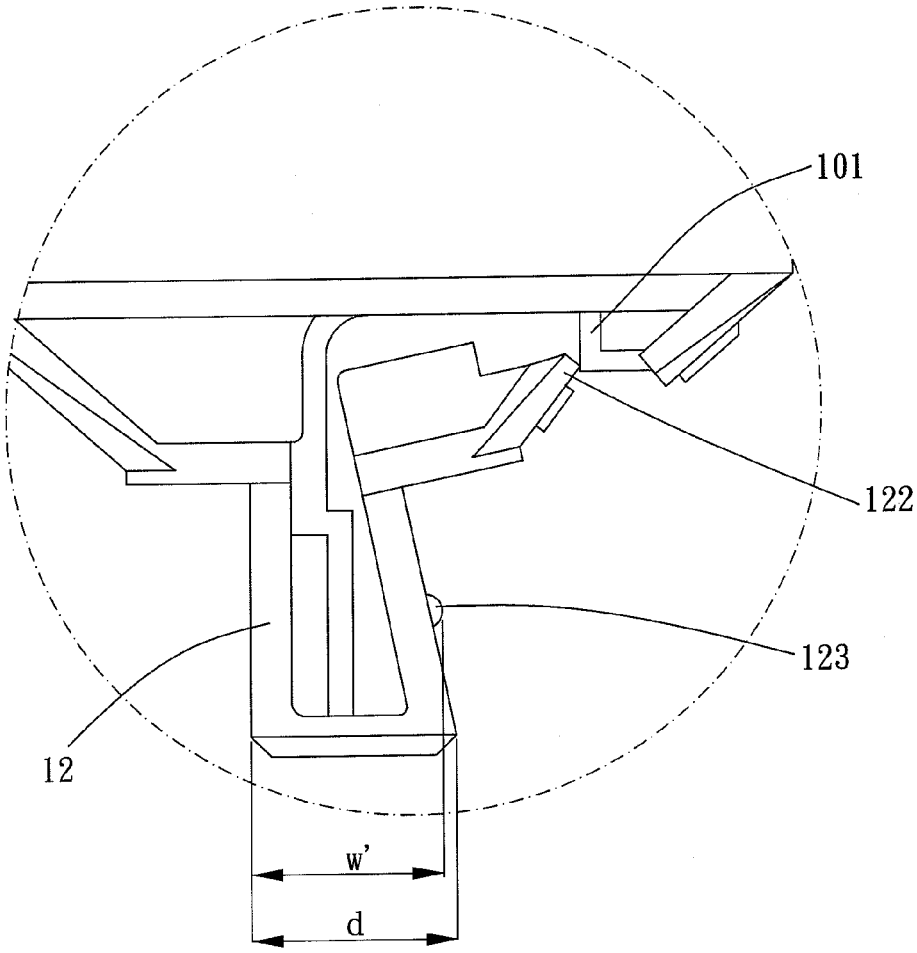
FIG. 6 is a partially enlarged drawing of FIG. 4.

The wedge portion 12 is adapted for a socket 2 to be sleeved therearound. A receiving space 121 is formed between the wedge portion 12 and the plate body 10. The wedge portion 12 is flexible and selectively deformable. One end of the wedge portion 12 toward the plate body 10 is connected to the plate body 10, and the wedge portion 12 is formed with a wedge corner portion 122. The wedge corner portion 122 is connected to the plate body 10 via a connecting edge 1221. The wedge corner portion 122 is selectively movable between a first position and a second position. The second end of the plate body 10 is formed with a blocking corner portion 101 extending inwardly toward the receiving space 121, and the wedge portion 12 is further formed with a projective positioning portion 123. In this embodiment, the wedge portion 12 includes an U-shaped structure. The U-shaped structure includes a bottom and two parallel sidewalls. One of the sidewalls is connected to the plate body 10 and a top of the other sidewall is formed with the wedge corner portion 122, and the positioning portion 123 projects from one of the sidewalls of the U-shaped structure. When the wedge corner portion 122 is located in the first position, a minimum distance between the respective outer side surfaces of the two sidewalls of the U-shaped structure is d, a distance between an outermost portion of the positioning portion 123 and the outer side surface of the sidewall opposite the outermost portion is w; when the wedge corner portion 122 is located in the second position, a distance between an outermost portion of the positioning portion 123 and the outer side surface of the sidewall opposite the outermost portion is w', as shown in FIGS. 5 and 6.

Figure 4:
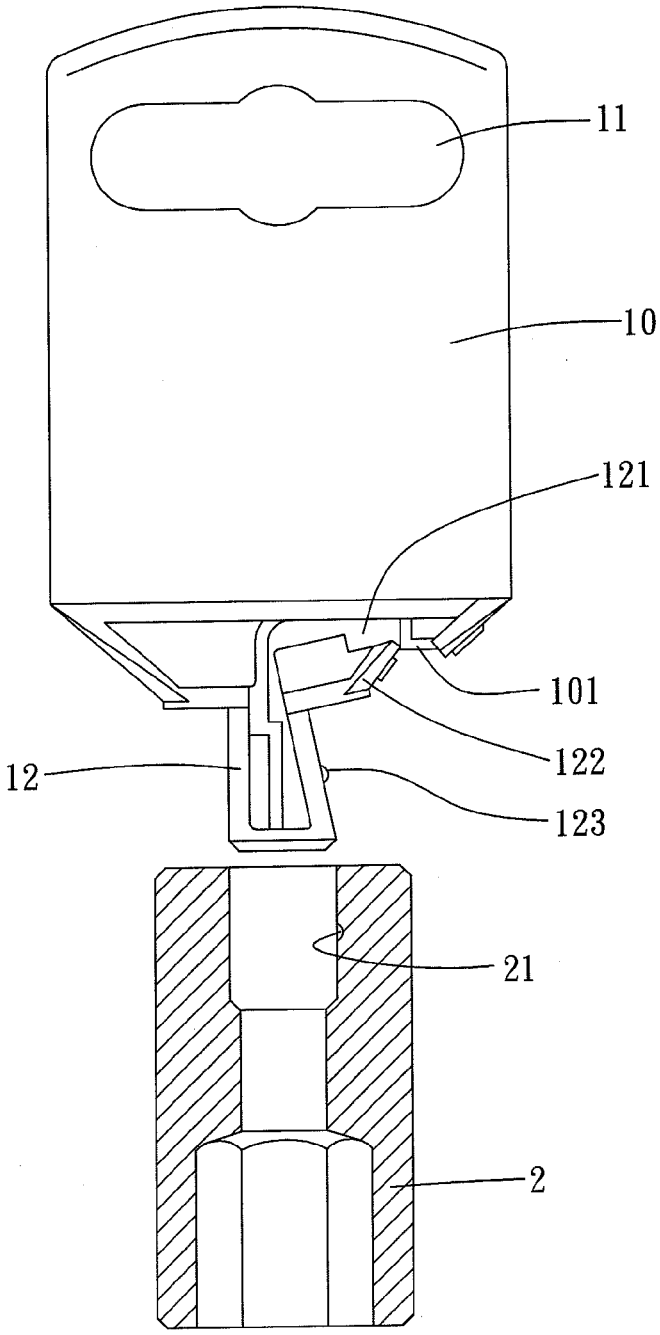
FIG. 4 is a view showing an anti-theft/safety hanger in use according to a preferred embodiment of the present invention.
Figure 7:
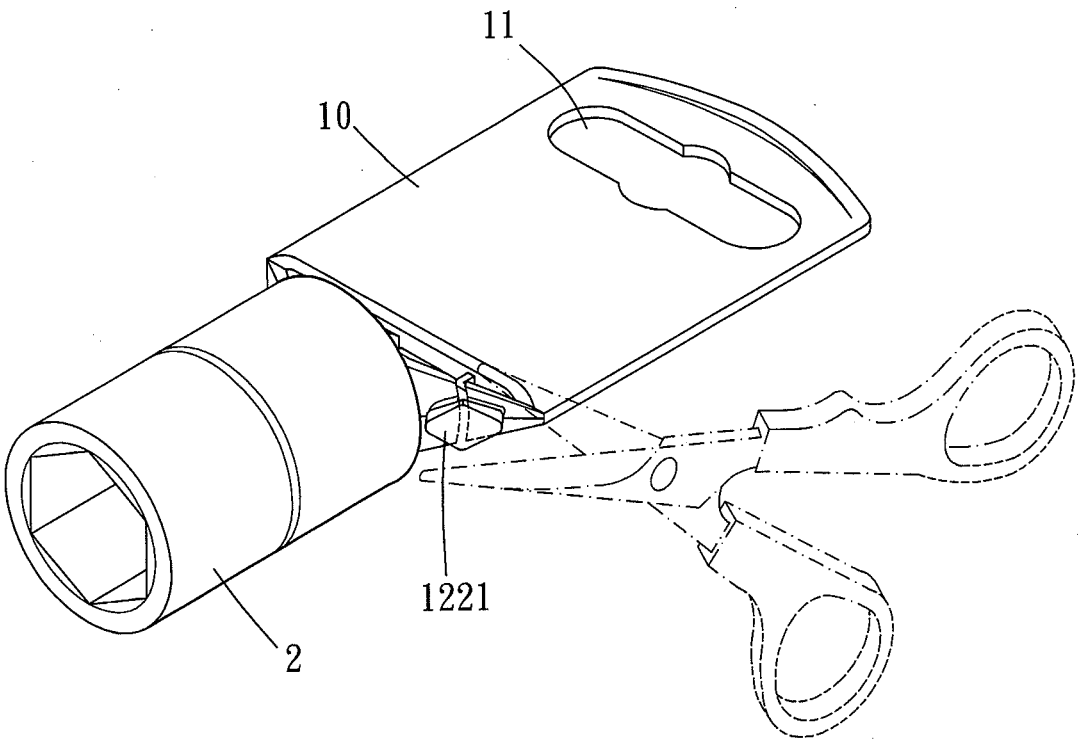
FIG. 7 is a view showing an anti-theft/safety hanger being detached according to a preferred embodiment of the present invention.

As shown in FIG. 3, when the connecting edge 1221 is uncut-off or unsnipped-off, the wedge corner portion 122 is located in the first position, the wedge portion 12 is limited by the connecting edge 1221 so that the wedge portion 12 is in a relatively undeformable status, and the socket 2 is blocked by the positioning portion 123 so that the socket 2 is blocked and undetachable from the wedge portion 12. More specifically, an interior surface of the socket 2 is formed with a positioning groove 21 for the positioning portion 123 to wedge therein. When the wedge portion 12 in a relatively undeformable status, the distance w is greater than a minimum distance traversing the interior space in the socket 2 but smaller than a maximum distance traversing the interior space in the socket 2, so that the socket 2 can be fixedly wedged by the wedge portion 12 and is undetachable. As shown in FIGS. 4 and 7, in application, a pair of scissors or long nose pliers or the like can be used to cut off or snip off the connecting edge. Since the wedge portion 12 is not limited by the cut-off connecting edge, the U-shaped structure of wedge portion 12 is slightly deformable, so that the user can push the socket toward the plate body 10 and the free-ended wedge corner portion 122 can be pushed into the receiving space 121 and blocked by the blocking corner portion 101 in the second position. Hence, the wedge portion 12 is depressed and the two sidewalls of the U-shaped structure are relatively closer to each other, and the positioning portion 123 relatively moves backward accordingly; the distance w' is less than the distance d so that the positioning portion 123 no more blocks the socket 2, and thus the user can move the socket 2 away from the plate body 10 so as to detach the socket 2 from the wedge portion 12.

Specifically, the wedge corner portion 122 and the blocking corner portion 101 are not continuously formed, the wedge corner portion 122 and the blocking corner portion 101 form a gap 102 therebetween as the connecting edge 1221 is uncut-off or unsnipped-off. The connecting edge 1221 is configured to be plate-shaped, and the connecting edge 1221 has two thicker end portions 1222 which are connected respectively to the wedge corner portion 122 and the plate body 10, the connecting edge 1221, relative to the two thicker end portions 1222, has a thinner middle portion 1223 between the two thicker end portions 1222, and the thinner middle portion 1223 has a thinnest region 1224 extending correspondingly above and along the gap 102. The wedge portion 12 has a first side wall 124 extending from the second end of the plate body 10, a second side wall 125 opposite and parallel to the first side wall 124, and a third side wall 126 laterally connected between the first and second side walls 124 and 125, the third side wall 126 is opposite and substantially parallel to the second end of the plate body 10, the first side wall 124 has an inverted L-shaped portion 127 which corresponds in shape to a corner portion 128 defined by an interior surface and an end surface of the socket 2 and which is for engagement with the interior surface and the end surface, and the wedge corner portion 122 is formed on a top end of the second side wall 125. An enhancing rib 129 extends integrally from a connection part 130 of the inverted L-shaped portion 127 which is located at least partly within the socket 2 and corresponds to the corner portion 128 of the socket 2 as the wedge portion 12 is sleeved around by the socket 2, the enhancing rib 129 is further integrally connected vertically to the second end of the plate body 10 and vertically to the third side wall 126.

Given the above, when the connecting edge is uncut-off, the socket cannot be detached from the hanger so as to provide the anti-theft function; when the connecting edge is cut off, the user only needs to move the socket upward relative to the hanger so that the wedge corner portion is positioned in the second position and no more a free end. Thus, the block of the socket by the wedge portion is completely released and the socket can be easily detached without pinching the wedge portion when the socket is moving away from the hanger. Hence, it is very convenient.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An anti-theft/safety hanger, including a plate body, the plate body including a first end and a second end corresponding to each other, the first end formed with a hanging portion, the second end formed with a wedge portion, the wedge portion adapted for a socket to be sleeved therearound, a receiving space being formed between the wedge portion and the plate body, the wedge portion being selectively deformable, one end of the wedge portion toward the plate body being connected to the plate body, the wedge portion formed with a wedge corner portion, the wedge corner portion being connected to the plate body via a connecting edge, the wedge corner portion being selectively movable between a first position and a second position, the second end of the plate body formed with a blocking corner portion extending inwardly toward the receiving space, and the wedge portion formed with a projective positioning portion;

wherein when the connecting edge is uncut-off or unsnipped-off, the wedge corner portion is located in the first position, the wedge portion is limited by the connecting edge so that the wedge portion is relatively undeformable, and the socket is blocked by the positioning portion so that the socket is undetachable from the wedge portion;

wherein when the connecting edge is cut off or snipped off, the wedge portion is relatively deformable so that the wedge corner portion is allowed to be pushed into the receiving space and is blocked in the second position by the blocking corner portion, the wedge portion is depressed so that the positioning portion moves backward, and the socket is unlimited by the positioning portion and permitted to detached from the wedge portion;

wherein the wedge corner portion and the blocking corner portion are not continuously formed, the wedge corner portion and the blocking corner portion form a gap therebetween as the connecting edge is uncut-off or unsnipped-off;

wherein the connecting edge is configured to be plate-shaped, and the connecting edge has two thicker end portions which are connected respectively to the wedge corner portion and the plate body, the connecting edge, relative to the two thicker end portions, has a thinner middle portion between the two thicker end portions, and the thinner middle portion has a thinnest region extending correspondingly above and along the gap;

wherein the wedge portion has a first side wall extending from the second end of the plate body, a second side wall opposite and parallel to the first side wall, and a third side wall laterally connected between the first and second side walls, the third side wall is opposite and substantially parallel to the second end of the plate body, the first side wall has an inverted L-shaped portion which corresponds in shape to a corner portion defined by an interior surface and an end surface of the socket and which is for engagement with the interior surface and the end surface, and the wedge corner portion is formed on a top end of the second side wall;

wherein an enhancing rib extends integrally from a connection part of the inverted L-shaped portion which is located at least partly within the socket and corresponds to the corner portion defined by the interior surface and the end surface of the socket as the wedge portion is sleeved around by the socket, the enhancing rib is further integrally connected vertically to the second end of the plate body and vertically to the third side wall.

2. The anti-theft/safety hanger of claim 1, wherein the hanging portion is an elongated hole.

* * * * *